US005938097A

United States Patent [19]

Lam

[11] Patent Number: 5,938,097

[45] Date of Patent: Aug. 17, 1999

[54] TAPE DISPENSING METHOD USING NON-UNIFORM TENSION TO REDUCE TAPE BREAKAGE

[75] Inventor: Joe Augustine Shing-Tak Lam, Richmond, Canada

[73] Assignee: Belcor Industries Inc, Richmond, Canada

[21] Appl. No.: 08/822,328

[22] Filed: Mar. 21, 1997

Related U.S. Application Data

[62] Division of application No. 08/524,933, Sep. 8, 1995, Pat. No. 5,676,298.

[51] Int. Cl.[6] ..... B65H 16/00; B65H 23/34; B65H 23/08

[52] U.S. Cl. ..... 226/1; 226/88; 226/195

[58] Field of Search ..... 226/1, 190, 191, 226/194, 195, 88; 242/563; 156/494, 229

[56] References Cited

U.S. PATENT DOCUMENTS

| | | | |
|---|---|---|---|
| 3,081,014 | 3/1963 | Anderson et al. | 226/195 |
| 3,148,585 | 9/1964 | Armstrong et al. | 226/195 |
| 3,353,765 | 11/1967 | Huck | 226/191 |
| 3,372,849 | 3/1968 | Hall et al. | 226/88 |
| 3,510,037 | 5/1970 | Sharpe | 226/88 |
| 3,529,757 | 9/1970 | Sharpe | 226/88 |
| 3,558,254 | 1/1971 | Cahill | 226/88 |
| 3,608,808 | 9/1971 | Wolf | 226/195 |
| 3,719,802 | 3/1973 | Boyer | 226/195 |
| 3,779,439 | 12/1973 | Fessop | 226/88 |
| 4,059,203 | 11/1977 | Wright | 226/88 |
| 4,072,554 | 2/1978 | McKibben | 226/88 |
| 4,316,664 | 2/1982 | Nishimoto | 226/88 |
| 4,332,339 | 6/1982 | Lüedemann et al. | 226/195 |
| 4,466,576 | 8/1984 | Simson | 226/191 |
| 4,675,069 | 6/1987 | Mattei et al. | 226/88 |
| 5,033,688 | 7/1991 | Georgitsis et al. | 242/563 |
| 5,213,246 | 5/1993 | Crowley | 226/88 |
| 5,367,746 | 11/1994 | Clement et al. | 242/563 |

FOREIGN PATENT DOCUMENTS

| | | | |
|---|---|---|---|
| 2837164 | 3/1980 | Germany | 156/494 |
| 0247811 | 7/1987 | Germany | 156/494 |
| 3061259 | 3/1991 | Japan | 226/195 |
| 0719929 | 3/1980 | U.S.S.R. | 226/195 |
| 0956584 | 4/1964 | United Kingdom | 226/195 |
| 2248827 | 4/1992 | United Kingdom | 226/195 |

*Primary Examiner*—Charles A. Marmon
*Assistant Examiner*—Matthew A. Kaness
*Attorney, Agent, or Firm*—C. A. Rowley

[57] ABSTRACT

A method for dispensing a ribbon of tape from a roll by using guide and feed rolls to apply a significantly higher tension to the ribbon along the longitudinal central portion of the ribbon than along the longitudinal side edge portions of the ribbon so that forces tending to tear the tape adjacent to the side edges of the tape are significantly less than those normally applied in drawing a ribbon of tape from a roll whereby breakage of the tape is minimized.

3 Claims, 8 Drawing Sheets

TAPE DISPENSING METHOD USING NON-UNIFORM TENSION TO REDUCE TAPE BREAKAGE

This application is a division of application Ser. No. 08/524,933 filed Sep. 8, 1995 now U.S. Pat. No. 5,676,298.

FIELD OF INVENTION

The present invention relates to a tape dispenser, more particularly, the present invention relates to a tape dispenser for reducing tape breakage.

BACKGROUND OF THE INVENTION

In the packaging of goods in containers, such as corrugated cardboard containers or the like, it is standard practice in many cases to apply a sealing tape along one end, across the top (or bottom) and along another end of such a container, to seal the container. Normally the tapes are dispensed as a strip from a roll. For many applications the tape will have a non-sticky and a sticky surface, i.e. a pressure sensitive side that is adhered to the carton. Such tapes will generally be referred to herein as sticky tapes.

Production rate in a packaging plant is extremely important. Thus, any down time may be extremely detrimental to the profits. One of the major contributors to down time is tape breakage in a tape dispenser and the required rethreading of the system before production may be resumed.

Normally breakage occurs due to the pulling force on the tape to peel the tape from the roll and apply the tape under tension to the article, i.e. the friction preventing rotation of the roll during dispensing, the momentum of the roll and the stickiness of the adhesive, the applied tension i.e. tension in the tape as it is applied all of which must be carried by the tape from the point of application where the tension is the highest to the point of separation of the ribbon or strip of tape from the roll of tape. It is not uncommon for rolls to have minor defects such as nicks or cuts adjacent to their lateral edges. Stress is concentrated at these nicks or cuts or other deformities when tension is applied to this tape and causes failure by propagation of the defect across the full width of the tape ribbon and thereby breakage of the ribbon or tape.

Obviously, the strength of the tape plays a role in the amount of tension that may be withstood without breakage but providing a tape with high strength is relatively expensive. For reasons of cost the packager uses or would prefer to use the less expensive tape that is more prone to breakage.

Dispensing system for delivering the tape to the point of application contribute significantly to amount of tape breakage and the ease of re-rethreading and thereby to the downtime of the equipment.

BRIEF DESCRIPTION OF THE PRESENT INVENTION

It is the main object of the present invention to provide a tape dispensing system wherein breakage is significantly reduced relatively to conventionally used dispensing systems.

It is a further object of the present invention to provide an easily threaded system to further minimize down time.

Broadly the present invention relates to a tape dispenser for withdrawing a sticky tape having a non-sticky surface and a sticky surface comprising a base, a source of said tape, means defining a tape path from said source, means for withdrawing tape from said source including means for applying tension to a strip of said tape extending from said source longitudinally of said strip, said means for applying tension including means for applying greater axial tension per unit width of said tape to a longitudinal central portion of said strip adjacent to an axial center line of said tape than the amount of tension per unit width of said tape applied each of a pair of longitudinal lateral portions of said strip, one of said pair longitudinal lateral portions being positioned adjacent to each lateral edge of said tape.

Said means for applying greater axial tension per unit width of said tape will preferably include a control roller defining a portion of said path over which said tape passes said control roller having a peripheral surface shaped to apply greater pressure on said central longitudinal portion of said tape strip extending along said path then is applied to said lateral longitudinal portions of said tape.

Preferably, said control roller will have axial length shorter than a width of said tape measured substantially perpendicular to said longitudinal center line of said tape so that significant portions of said longitudinal lateral portions are positioned outward of said roller beyond their adjacent axial ends of said control roller Preferably said source will comprise a roll of said tape and said path will further be defined by a turning roller around which said path extends immediately before if passes around said control roller.

Preferably, the desired diameter of said surface of said turning and control rollers gradually diminished adjacent each said axial end of said rollers to gradually reduced the pressure applied to said tape in each said longitudinal side I portion as the distance from said axial center line of the tape increases.

Preferably, said tape wraps said turning and said control rollers with said non-sticky side of said tape in face to face relationship with the periphery of said turning roller and said sticky surface of said tape in face to face relationship with said control roller.

Preferably, said dispensing system will further comprise first and second guide rollers mounted on a lever for movement relative to said turning and control rollers between a first position and the second position, each of said guide rollers having a bowed surface between axial ends of said rollers, each having a diameter at its axial ends smaller than the diameter adjacent to its mid-point between its said axial end.

Preferably, a positioning roller will form an open nip with said second guide roller, said open nip will be dimensioned to freely receive said tape therethrough.

Preferably, a tongue will project substantially tangential from said second guide roller along a path of travel of said tape, said tongue extending substantially axially of said path and from adjacent said mid-position of said second guide roller.

Preferably, the dispenser will further include a former having a pair of tape deforming portion positioned one on each side of said tongue in position to deform said tape into an arch about said tongue when said lever is in said first position.

Preferably, said former will be fixed said base and said arm moves relative to former to open a passage axially of said rollers into to said tape path.

Broadly the present invention also relates to a tape dispenser including a base, an arm, means mounting said arm for movement relative to said base between a first position and a second position, a guide means having a convex bowed surface and an applicator roller which define therebetween a portion of a tape path, said guide means and said applicator roller mounted in spaced relationship on said arm, a former fixed to said base in a position to contact and deform side edges of a tape in said tape path and bow said tape into a convex cross-sectional shape when said arm is in said first position and to be clear of said tape when said arm is moved from said first position.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
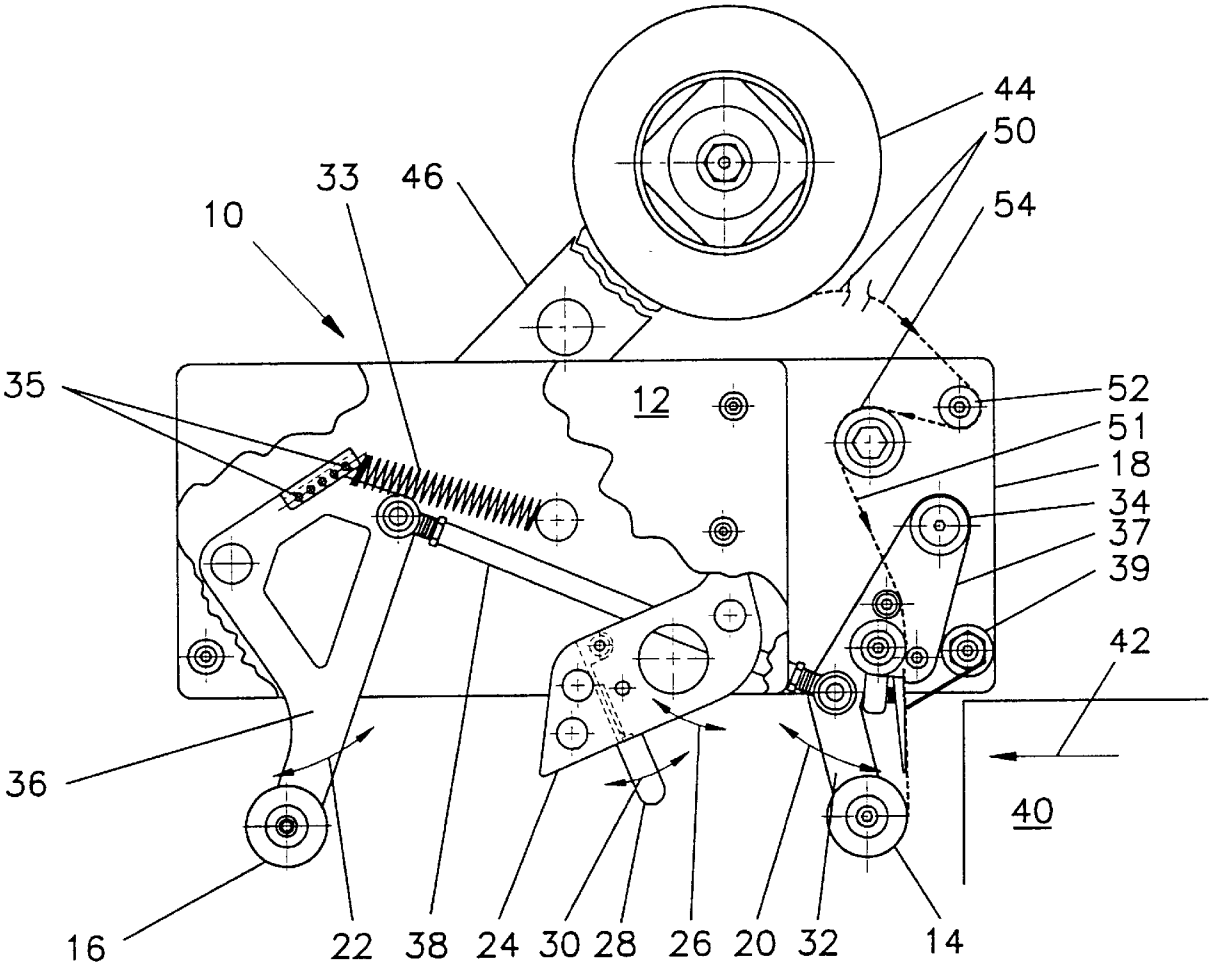
FIG. 1 is a side elevation of a typical tape dispenser and applicator modified to include the dispensing system of the present invention.

As shown in FIG. 1, the taping system 10 includes the standard tape applying mechanism which is primarily contained within the box or area 12 and as in a conventional system, includes an applicator roller 14 and a pressing roller 16, both of which are moveably mounted (as indicated by the arrows 20 and 22) on the main support frame generally indicated at 18. A suitable cut-off mechanism indicated generally at 24 is movable as indicated by the arrow into a retracted position and includes a knife shield movable from retracted to exposed position by pivotal movement induced by the arm or feeler 28 contacting the surface of the box to lift the shield to expose the knife as represented by the arrow 30.

The applicator roller 14 is mounted on a lever 32 pivoted to the main frame via a pivotal connection 34. Movement of the arm 32 as represented by the arrow 20 about. the pivotable connection 34 from the first or read position as shown to a second position (not shown) in the illustrated embodiment is resisted by a suitable spring 33 (FIG. 1) the tension of which may be adjusted by selecting the proper hole 35 into which one end of the spring is received. The holes 35 are formed in the arm or lever 36 on which the trailing roller or pressure roller 16 is mounted and the forces from the spring 33 are transmitted to the arm 32 via the connecting rod 38 that interconnects the arm or lever 32 with the arm or lever 36 Thus the spring 33 in part defines the force necessary to displace the applicator roller 14.

The arm 36 is also pivoted to frame 18 in the conventional manner on an axis), and the two arms 32 and 36 interconnected via a rod or the like 38 are moved together by movement of the box schematically indicated at 40 in the direction of the arrow 42 which forces the applicator roller 14 and arm 32 to pivot around pivot 34 and move out of the path of box 40. The rod 38 connecting the arm 36 to the lever 32 lifts the arm 36 and roller 16 and moves them to the right in FIG. 1 out of the path of the box 40 until the opposite end of the box 40 clears the roller 14.

The cut-off mechanism in the illustrated arrangement contacts the surface of the box and lifts out of the way to a retract position. Similarly, the lever 28 moves by its contact with the box to expose the knife.

The arm 32 is bias in the conventional manner by a spring 33 to urge the arm 32 in a counterclockwise wise direction into a first position wherein the edge 37 of the arm 32 is forced into contact with the stop 39 fixed to the main frame 18. This first position is in effect the ready position to receive the next box 40 to be taped.

Figure 3:
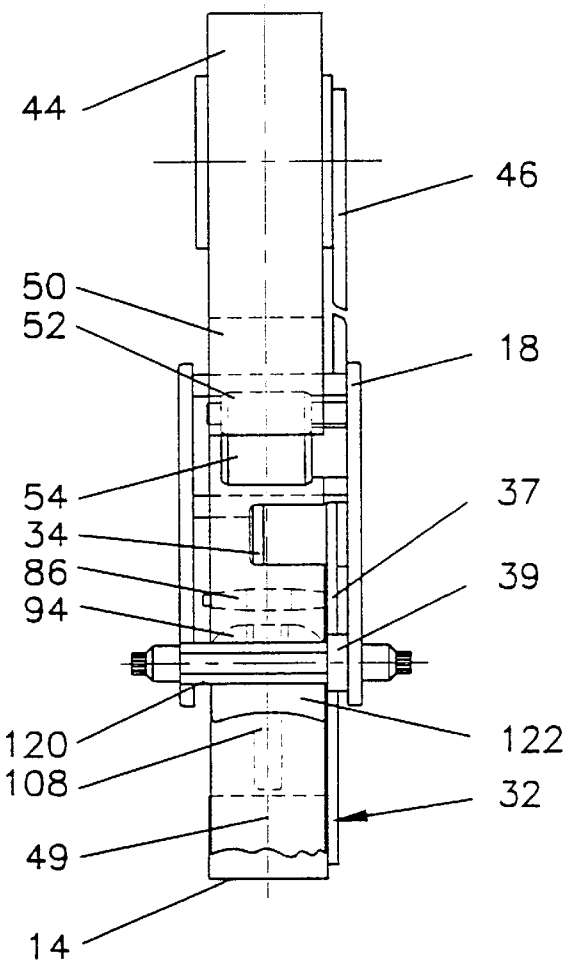
FIG. 3 is an end view of the dispensing system of the present invention with a transparent tape extending along the tape path.

A roll of tape 44 which will normally be a sticky tape having a sticky (adhesive) surface 55 and a non-sticky surface 57 (see FIG. 4) and a width W measured perpendicular to the longitudinal axis 49 of the tape 50 (see FIG. 3). The roll 44 is supported on a support arm 46 extending from the main frame 18.

The above description of FIG. 1 generally describes a conventional tape applicator as used throughout the industry and describes a preferred type tape applicator with which the tape dispenser of the present invention is intended to be used.

Figure 2:
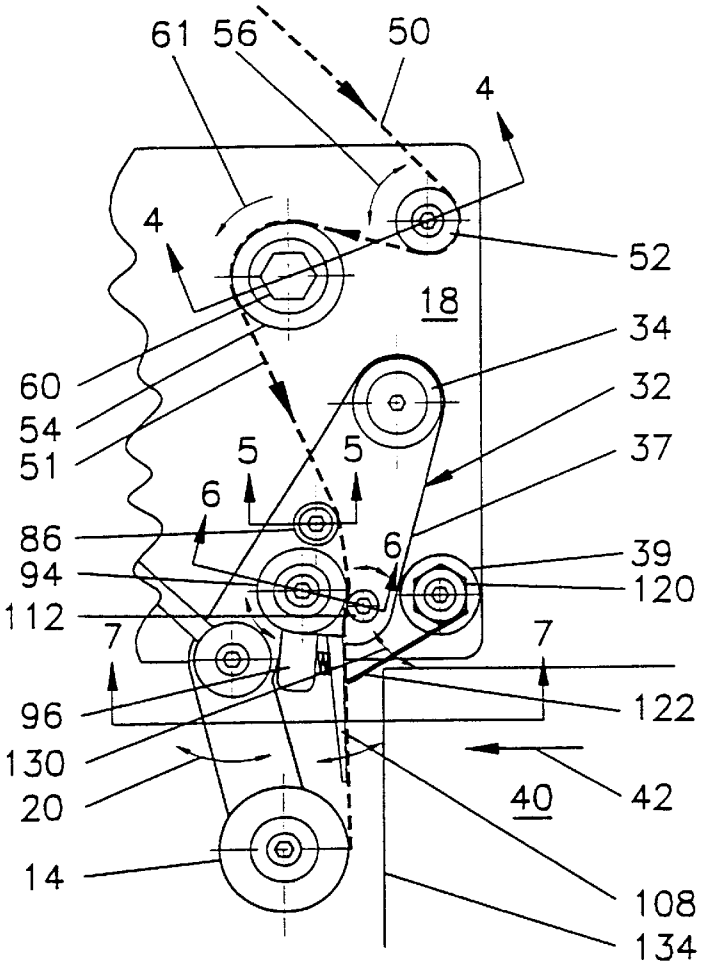
FIG. 2 is an enlarged view illustrating the dispensing system of the present invention.
Figure 4:
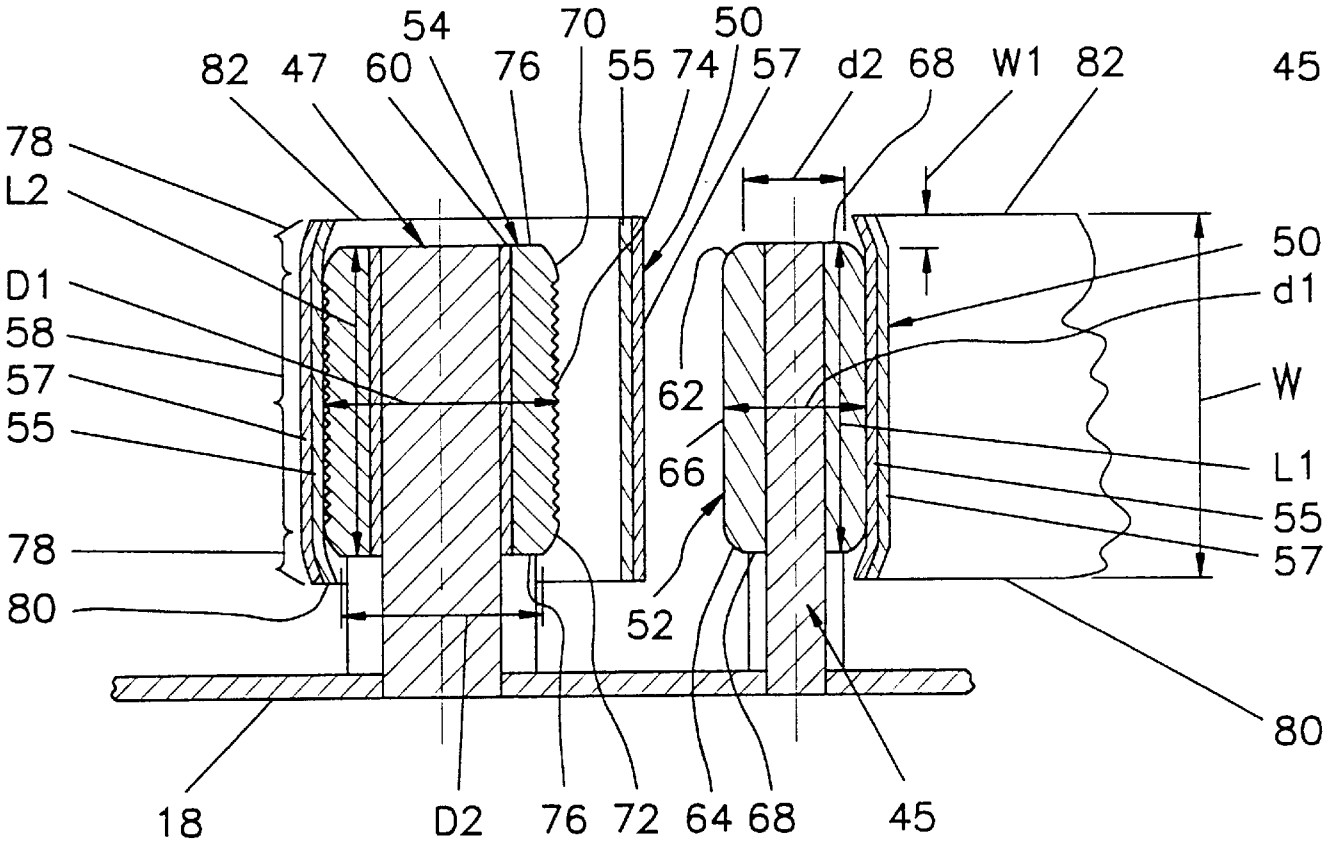
FIG. 4 is a section along the line 4—4 of FIG. 2.

Referring now to FIGS. 2 and 4. The tape 50 leaving the roll 44 first passes around a turning roller 52 and onto a control roller 54, each of which is mounted for rotation about an axles 45 and 47 respectively fixed to the main frame or base 18. The roller 52 is free to rotate in either direction as indicated by the arrow 56 while the roller 54 is mounted on a break and one way clutch schematically represented at 60, the break defines the force necessary to rotate the roller 54 to dispense the tape 50 and the clutch permits rotation only in one direction as indicated by the arrow 61. The resistance to rotation of the roller 54 as set by the break 60 determines the maximum tension carried by the tape 50 which is the tension carried between the roller 54 and the point of application of the tape i.e. the box 40.

Referring to FIG. 4, the peripheral surfaces of these rollers 52 and 54 are each shaped to have a major diameter as indicated by $d_1$ on roller 52 and $D_1$ on roller 54 positioned to engage the tape 50 substantially along the longitudinal central portion 58 of the tape that extends on opposite axial center line 49 (see FIG. 3) of the tape path 51 and have a smaller diameter $d_2$ and $D_2$ respectively adjacent to each of their axial ends. Curved sections 62 and 64 on roller 52 interconnect the major diameter portion with a minor diameter section 68 of the rollers 52. and similarly curved sections 70 and 72 smoothly interconnecting the main diameter portions 74 of roller 54 with the minimum diameter section 76. A mid portion 58 of the tape 50 engages the large diameter portions of the rollers 52 and 54 The axial length of each of the rollers 52 and 54 is indicated by the dimension $L_1$ and $L_2$ respectively which normally will be equal are shorter than the width W of the tape 50 so that a side edge portion 78 free of contact with the rollers 52 and 54 is formed along each side edge 80 and 82 of the tape 50 on opposite sides of the central portion 58. The width $w_1$ of each of the side edge portions 78 is preferably the same and extend respectively from the intersection of the curve section 62 and 64 with the central portion of the roller 52 and/or from the intersection of the curve sections 70 and 72 with the central sections 74 of the roller 54. Generally, the central sections and 74 will contact the central portion 58 of the tape 50 which will be symmetrically position relative to the center line 49 of the tape path. The side portions 78 at each free edge 80 and 82 are thus free to move into a more relaxed position than the central portion 58 since the pressure on the outer portion 78 is obviously significantly less than the pressure between the central portions and 74 of the rollers 52 and 54 and the longitudinal central portion 58 of the tape 50.

The width $w_1$ is set to reduce the stress (tension) applied to the tape 50 at the edges 80 and 82 but must not be so long that the side edge portions 78 fold over on themselves and thereby affect the operation of the equipment and the positions of the axial ends of the rollers 52 and 54 and their respective central portions will be sized accordingly. It will be apparent that for different thicknesses (strength) and/or widths of tape the dimensions may be adjusted accordingly. Generally, the edges 80 and 82 will not extend beyond the axial ends of the rollers 52 and 54 by more than about ¼ inch and the curved section 62, 64, 70 and 72 will interest their respective central portions to define the width w of the side portions 78 to be between about 10 and 30% of the width W of the tape 50.

Figure 5:
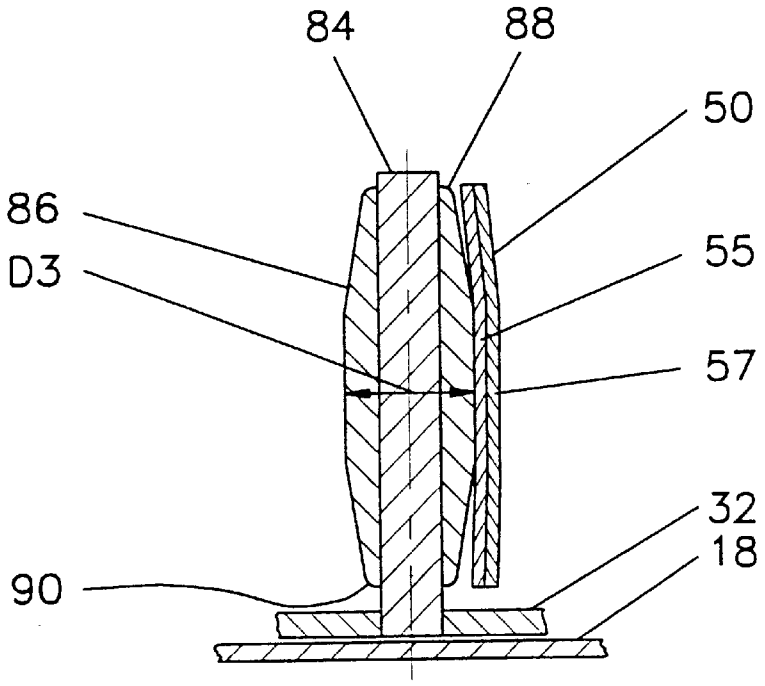
FIG. 5 is a section along the line 5—5 of FIG. 2.
Figure 6:
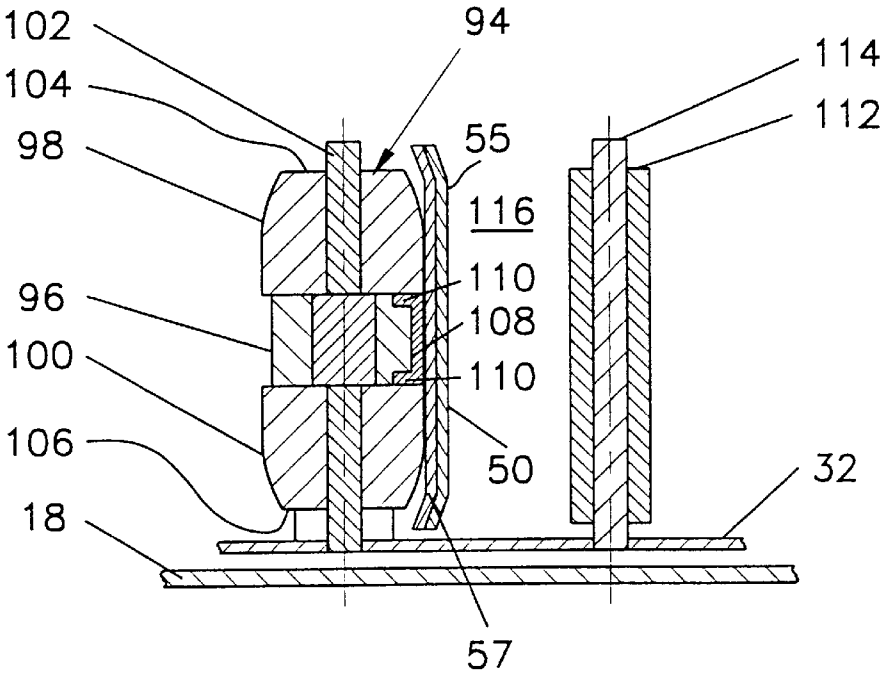
FIG. 6 is a section along the line 6—6 of FIG. 2.

The tape 50 leaves the roller 54 and travels along the path as indicated by the dash line 51 to wrap the guide roller 86 (see FIG. 2) which rotates about an axle 84 (FIG. 5). The roller 86 is essentially a bowed roller, i.e. has a maximum diameter $D_3$ midway between the axial ends 88 and 90 of the roller and that substantially aligns with the axial center line 49 of the tape 50 or tape path 51. The bowed shape of the roller 86 reverses the bow or curve cross-sectional shape applied to the tape by the rollers 52 and 54 initiates the formation of the curvature of the tape for extension into a projecting article receiving position. This continues the tension distribution so that less stress is carried by the side portions 78 than the central portion 58 and generated by the pulling action applied by the box 40 adjacent to the free end of the tape 50. The adhesive surface 55 of the tape 50 is away from the surface of the bowed roller 86.

From this bowed roller 86 the tape path 51 passes around a larger diameter guide roller 94 which is made with a central fixed section 96 and a pair of curved end sections 98 and 100 that are rotatable on the axis 102, i.e. the section 96 is fixed and does not rotate relative to the axis 102 whereas the curved end sections 98 and 100 are free to so rotate. The curved sections 98 and 100 combine to provide a substantially convex bowed surface to the roller 94 to contact and shape the tape 50 with the maximum pressure (tension) being applied to the central portion 58.

Each of the curved end sections 98 and 100 are substantially similarly shaped and have a maximum diameter adjacent to the center or adjacent to the fixed section 96 and a minimum diameter adjacent there free or axial ends 104 and 106 and the tape 50 passes around the roller 94 with its non-adhesive surface 57 supported by the roller 94.

A guiding and positioning tongue 108 has one end pivoted on the fixed section 96 by ears 110. The tongue 108 extends substantially tangentially from the roller 94 and substantially parallel to the tape path 51 between the rollers 94 and 14 which path is essentially tangent to the two rollers 94 and 14. In some cases the surface may traverse the path 51 to aid in convexly bowing the tape 50 as will be described below.

A positioning roller 112 mounted on an axle 114 cooperates with roller 94 to form an open nip 116 through which the tape 50 (tape path 51) passes.

The surface of the roller 112 is preferably roughen to minimize the possibility of the adhesive surface 55 sticking thereto and functions to position the tape 50 relative to the roller 94.

The rollers 86, 94 and 112 have their axis mounted on the lever 32 and thus, pivot with the lever 32 when the box 40 pushes on the roller 14 moving the lever from the position shown in FIGS. 1 and 2 into a second position.

The fixed block 96 projects from the axial 102 in the direction of the path 51 of the tape 50 and the tongue 108 has a U-shaped bracket 116 then encircles the block 96 and limits the travel of the tongue 108 away from the block 96. A suitable spring 118 urges the tongue 108 into position remote from the block 96 to hold tongue 108 in the position described above and/or as shown in FIGS. 2. and 3.

Figure 7:
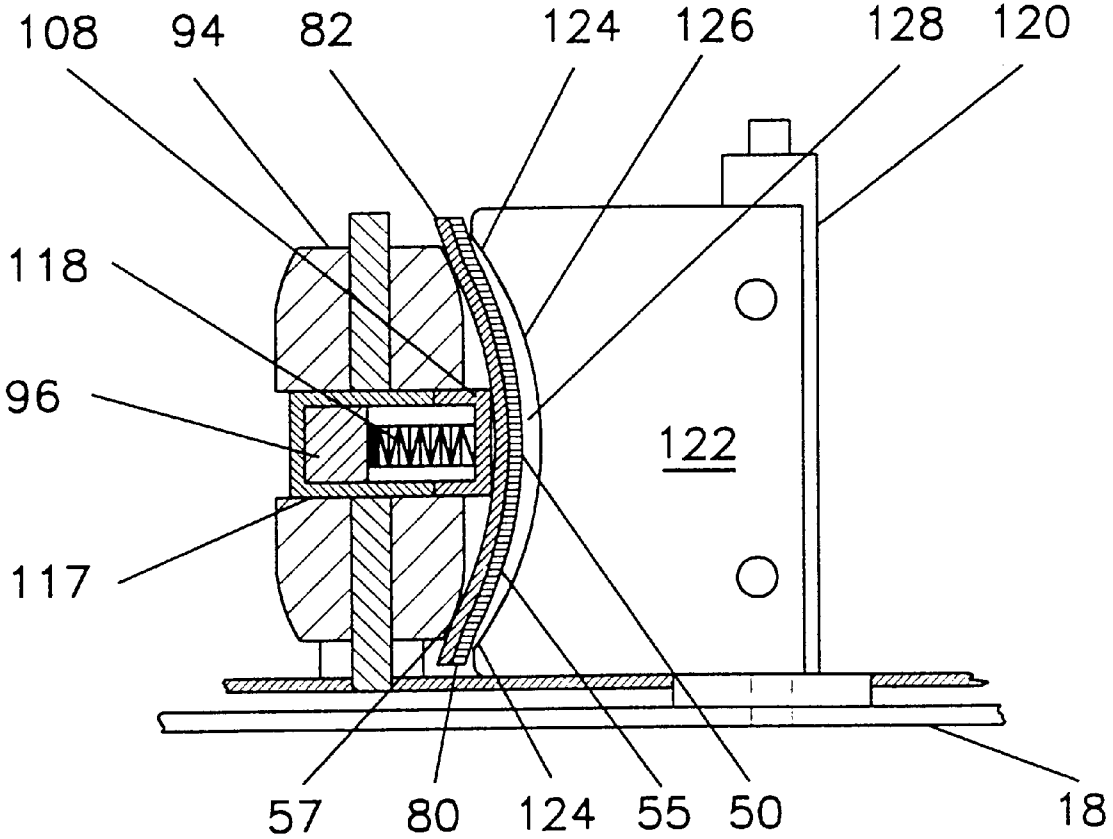
FIG. 7 is a section along the line 7—7 of FIG. 2.

Fixed to a post 120 mounted on the frame 18 is a former 122 that has a free edge 124 curved to provide a pair of forming sections 124 each in position to contact the tape 50 one adjacent to each of its lateral edge 80 and 82 and to deform side portions 78 the tape 50 to form the tape 50 into a convex cross-section with the sticky side 55 at the major diameter side of the shape i.e. the tape is deformed around opposite sides of the tongue 108 (see FIG. 7). The forming sections 124 are interconnected by curve section 126 that provides ample clearance 128 between the tape 50 and the free edge of the former 122. The camming or forming sections 124 extend to the opposite side of the path 51 than the post 120 i.e. the forming sections 124 extend to a position beyond the plane of the path 51 at the maximum diameter portion of the roller 94, so that the sections 124 are to the left of the surface of the tongue 108 in FIG. 7. This causes the tape 50 bowed around the tongue 108 so that the tape has moment of inertia that resist folding or deflection of the tape in the direction perpendicular to its longitudinal axis.

The above description of the former 122 applies when the lever 32 is in the first (ready) position as illustrated. However, since the post 120 is fixed to the frame 18 when the lever 32 is pivoted away from the first position, the tape is moved clear of the camming surfaces 124. This relative movement facilitates the operation of the tape dispensing and opens the path for simplified threading In operation, when the box 40 is moved through the equipment, the tape 50 extends, as indicated in FIG. 2, onto the roller 14 where it is held generally by static forces and in part due to the convex shape of the tape 50 which impairs its bending out of the path 51. One of the main functions of the tongue 108 is to steady the tape against displacement from the path 51 for example by air movement and better ensure the tape remains along the path 51 for application to the next box 40. Movement of the box 40 deflects the former 122 which is made of resilient material and moves it out of the way as indicated by the arrow 130 in FIG. 2.

Continued movement of the box 40 in the direction of the arrow 42 presses the leading face of the box 40 into contact with the tape supported on the roller 14, i.e. the leading face 134 of the box 40 is pressed against the sticky surface 55 of the tape 50. Further continued movement of the box forces the arm 32 to pivot around the pivot 34 in opposition to the spring 33 urging the arm 32 to the first position as illustrated in FIG. 2. The spring 118 is also compressed and the tongue 108 displace out of the path of the box 40. The roller 14 is forced out of the path of the box 40 as is the tongue 108 and the movement of the lever 32 moves the lever 36 out of the way. Contact of the box with the cut-off mechanism 24 and the safety device 28 moves these elements out of the way until the box 40 clears them. When the box clears the roller 14 the roller 16 is still in contact with the other upper surface of the box 40 and the interconnecting arm 38 prevents return of the lever 32 to the position shown in FIGS. 1 and 2 until the application of the tape is substantially completed.

Figure 8:
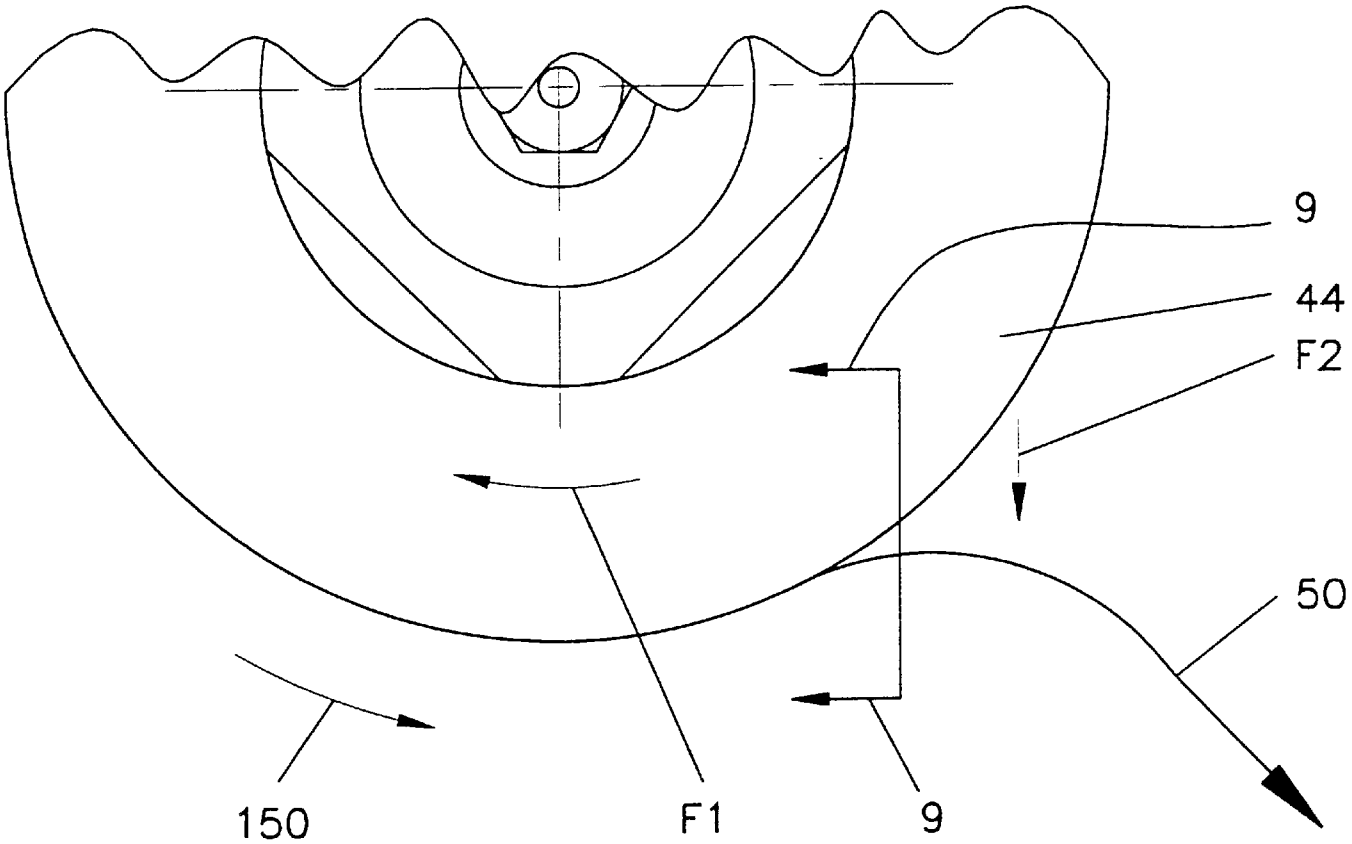
FIG. 8 is a schematic illustration of the separation of a tape ribbon from a roller of tape.
Figure 9:
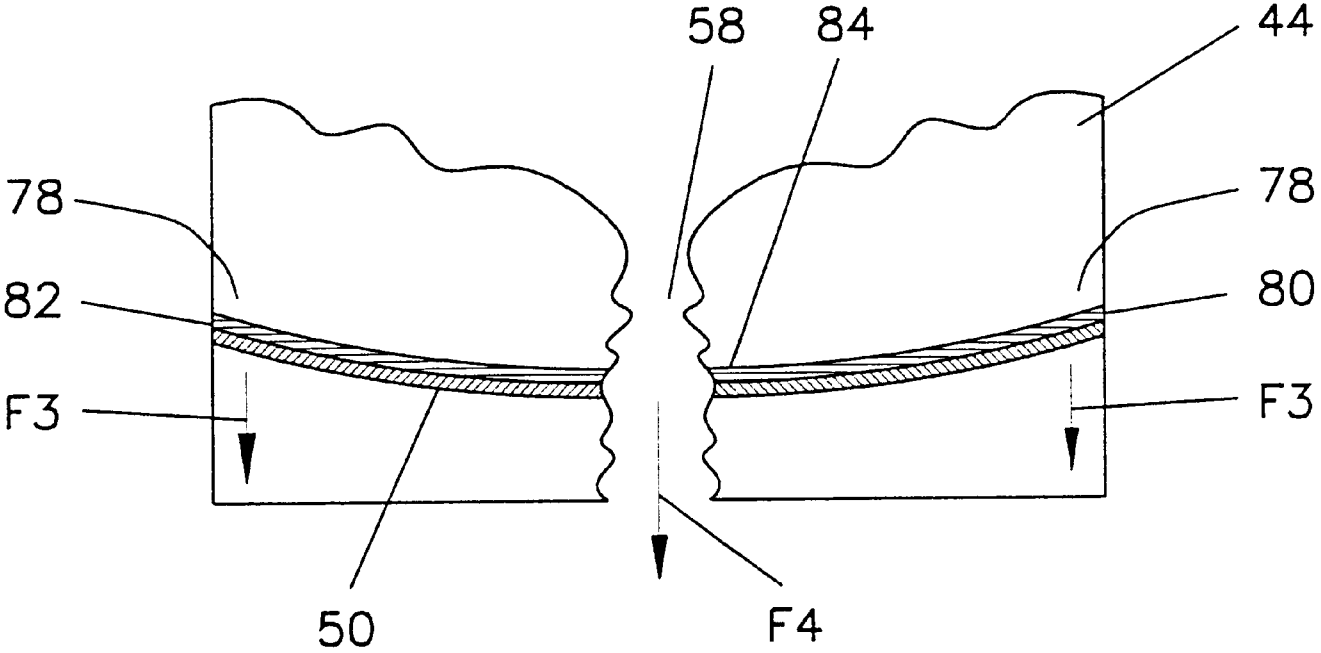
FIG. 9 is a view along the line 9—9 of FIG. 8.

Referring to FIG. 8, the mechanism by which it is believed the present invention reduces breakage will be described with respect to the peeling of the tape 50 from the roll 44. It will be apparent that the distribution of stress of tension will extend substantially the fill length of the tape from the roll 44 to it point of application i.e. to the box 40. Clearly the maximum tension is applied at the end from which the tape is pulled i.e. end at the box 40 thus the provision to reduce tension or stress in the side portions 78 must to have maximum effectiveness be applied from the roll 44 to the box 40.

It will be apparent that to pull the tape 50 from the roll 44 requires forces sufficient to first overcome the friction force indicated at $F_1$, resisting rotation of the roll 44 in the direction of the arrow 150 and requires a second force $F_2$ to pull the tape 50 from the roll 44, i.e. to break the adhesive bond between the sticky side 55 of the tape 50 and the non-sticky side 57. The force referred to herein are intended to describe unit forces i.e. forces per unit with of the tape 50 over which they are applied.

Throughout the full length of the path 51 between the roll 44 and the box 40 the portions 78 adjacent to the free edges 80 and 82 are relatively slack compared to the central portion 58 that is pressed against the large diameter portions of the rollers 52 and 54. Because the longitudinal side portions 78 are not under pressure against the rollers 52 and 54, the majority of the tension in the tape 50 is carried in the portion 58 spaced from the end edges 80 and 82 of the tape. Thus, there is a force transmitted via the tape extending from the roller 52 to the roll 44 that has a magnitude $F_2$ in portions 78 ($F_3$ will normally be the same on both sides of the tape although it may be slightly different) and a significantly higher force $F_4$ in the central portion 58.

The minimum value of force $F_3$ is obtained when the force $F_3$ is equal to the force required to separate the sticky side 55 of the tape 50 from the non-sticky side 57 whereas the force $F_4$ which will always be larger than the force $F_3$ will equal the added force necessary to complete the separation between the sticky 55 and non-sticky side 57 of the tape 50 and to overcome friction forces $F_1$.

By reducing the forces in the portions of 78 along the length of the path 51, the probability of tape breakage is reduced significantly since in most cases, fracture of the tape occurs as above described by propagation of an edge crack, i.e. a crack extending from one or the other of the side edges 80 or 82. The reduced tension in these areas reduces the forces tending to open these crack Since $F_3$ in the side portions 78 is significantly less than $F_4$ in the central portion 58 at substantially any point along the path 51 the risk of a cut or tear or defect adjacent to the edge 80 or 82 propagating across the full width of the tape 50 is minimized.

The relative movement of the path 51 and the former 122 when the arm 32 is moved from its first position shown in FIG. 2 reduces the likelihood of the tape 50 sticking to the former 122 (as is a significant problem with many other known formers) and facilitates rethreading since entrance to the path 51 in a direction axially of the rollers is uninhibited when the arm 32 has been displaced from the first or ready position of FIG. 2.

Having described the invention, modifications will be evident to those skilled in the art without departing from the scope of the invention as defined in the appended claims.

We claim:

1. A method of minimizing tape breakage when dispensing tape from a roll and directing its leading end along a path by pulling said tape from said roll and along a significant portion of said path comprising applying a higher pulling force axially of said tape along a longitudinal axial central portion of said tape, freeing side portions of said tape positioned on opposite sides of said central portion and one adjacent to each lateral edge of said tape to deform said tape so that said side portions may fold relative to said central portion so that significantly less axial force is applied to said side portions of said tape than to said central portion so that said application of said axial pulling force generates axial tension in said tape in said central portion greater than axial tension generated in each of said side portions, said higher pulling force providing a major portion of force directly pulling said tape from said roll and maintaining said higher tension in said central portion than in said side portions along substantially the full length of said path so that and the likelihood of breakage of said tape is reduced compared with pulling said tape from said roll by applying a substantially uniform axial pulling force across substantially the full width of said tape.

2. A method as defined in claim 1 wherein said applying a higher pulling force axially of said tape along a longitudinal axial central portion of said tape comprises applying a greater pressure perpendicular to said axial centerline to said tape adjacent to said axial center line of the tape than is applied to said side portions.

3. A method as defined in claim 2 further comprising adhering said leading end of said tape to an article to be taped and moving said article to apply substantially the total of said pulling force axially of said tape.

* * * * *